US006120267A

United States Patent [19]

Cunningham

[11] Patent Number: 6,120,267

[45] Date of Patent: Sep. 19, 2000

[54] PROGRESSING CAVITY PUMP INCLUDING A STATOR MODIFIED TO IMPROVE MATERIAL HANDLING CAPABILITY

[75] Inventor: Steven L. Cunningham, Springfield, Ohio

[73] Assignee: Robbins & Myers, Inc., Dayton, Ohio

[21] Appl. No.: 09/053,372

[22] Filed: Apr. 1, 1998

[51] Int. Cl.[7] ..... F04C 2/107; F04C 5/00

[52] U.S. Cl. ..... 418/48

[58] Field of Search ..... 418/15, 48, 153

[56] References Cited

U.S. PATENT DOCUMENTS

| | | | |
|---|---|---|---|
| 2,545,604 | 3/1951 | Byram | 418/48 |
| 2,686,618 | 8/1954 | Mateer | 222/378 |
| 3,139,035 | 6/1964 | O'Conner | 418/48 |
| 3,195,641 | 7/1965 | Becker | 166/106 |
| 3,271,081 | 9/1966 | Huddleston | 302/14 |
| 4,325,682 | 4/1982 | Willis | 418/48 |
| 4,415,316 | 11/1983 | Jurgens | 418/48 |

FOREIGN PATENT DOCUMENTS

| | | | |
|---|---|---|---|
| 498368 | 12/1953 | Canada . | |
| 223335 | 5/1987 | European Pat. Off. | 418/48 |
| 0330640 | 5/1989 | European Pat. Off. . | |
| 1563182 | 11/1969 | France | 418/48 |
| 2372333 | 7/1978 | France | 418/48 |
| 1959448 | 5/1971 | Germany | 418/48 |
| 2002793 | 7/1971 | Germany | 418/48 |
| 2316127 | 10/1974 | Germany | 418/48 |
| 2057860 | 1/1980 | Germany | 418/48 |
| 3304751 | 8/1984 | Germany | 418/48 |
| 4164179 | 6/1992 | Japan | 418/48 |
| 2037372 | 7/1980 | United Kingdom | 418/48 |

*Primary Examiner*—John J. Vrablik
*Attorney, Agent, or Firm*—Thompson Hine & Flory LLP

[57] ABSTRACT

A progressing cavity pump in which portions of the stator have been removed or cut away so as to provide a degree of radial access to the cavities formed by the pump elements within the progressing cavity pump suction chamber. One embodiment of such a stator includes a removed portion which results from a planar cut that starts from the suction end of the stator, proximal the central axis of the internal stator bore, is angled towards the discharge end of the stator and outwardly away from the central axis, and intersects an internal helical groove of the stator that defines a first cavity. In another embodiment of the stator, the removed portion of the stator is a radial "cut-out" which follows the internal helical groove of the stator. Accordingly, when one of such modified stators is extended into a suction chamber of a progressing cavity pump system, the material being pumped will circumferentially surround the stator and will enter into the cavities formed by the stator and pump elements through the side of the stator through the removed portions.

7 Claims, 6 Drawing Sheets

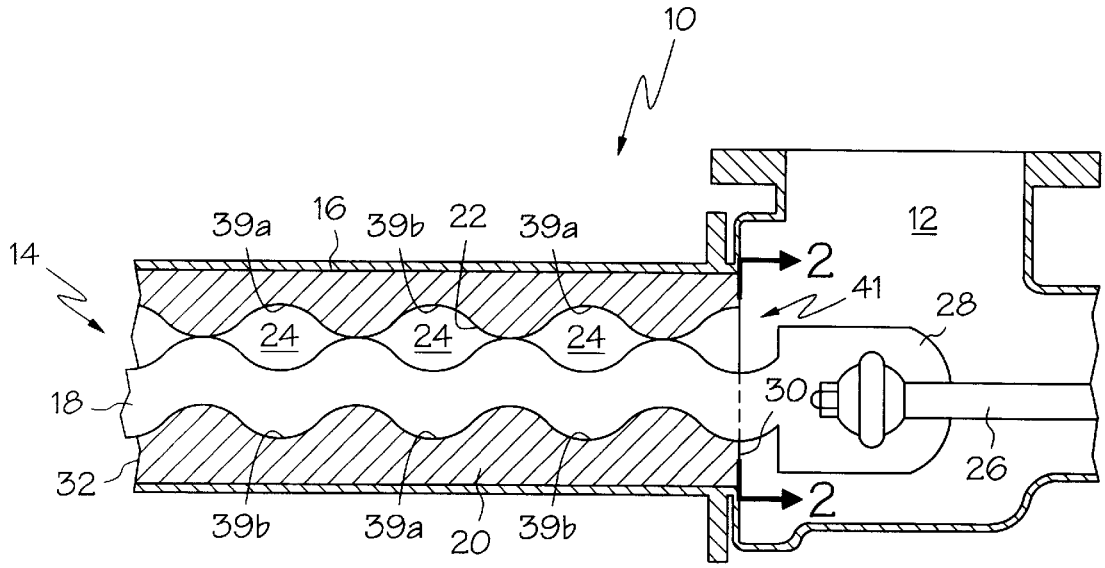
FIG. 1
PRIOR ART
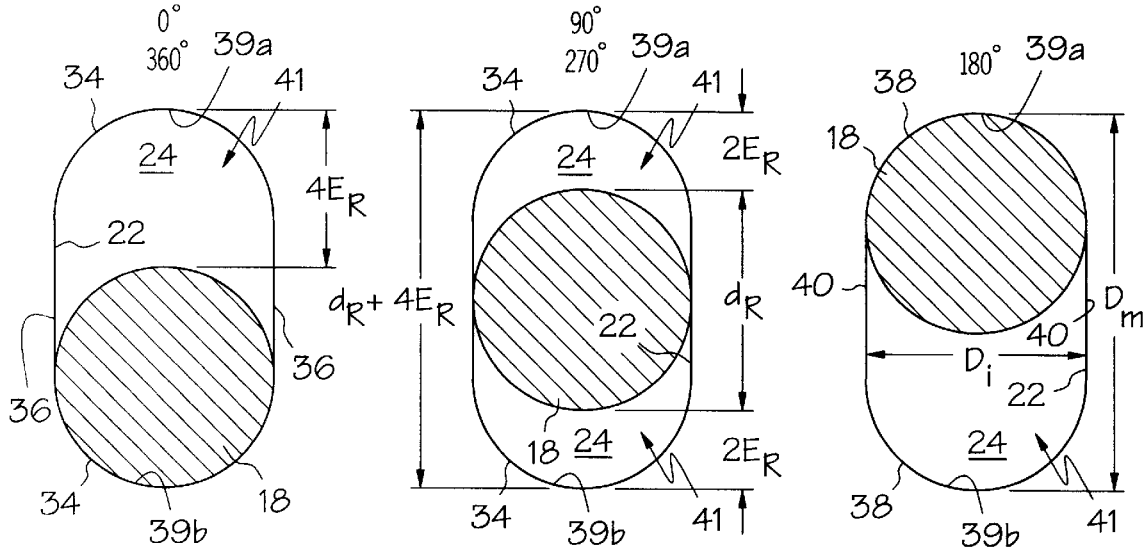
FIG. 2A
PRIOR ART
FIG. 2B
PRIOR ART
FIG. 2C
PRIOR ART

PROGRESSING CAVITY PUMP INCLUDING A STATOR MODIFIED TO IMPROVE MATERIAL HANDLING CAPABILITY

BACKGROUND

The present invention relates to helical gear pumps, and more particularly, to helical gear pumps in which a portion of the stator extending into an inlet chamber has been modified to improve the material handling capability of the pump.

A typical helical gear pump, or progressing cavity pump, comprises a rotor having one or more externally threaded helical lobes which coact with a stator having an internal bore extending axially therethrough, where the bore includes a plurality of helical grooves (one more helical groove than the number of helical lobes of the rotor). Pumps of this general type are typically built with a rigid metallic rotor and a stator which is formed from a flexible or resilient material such as rubber. The rotor is made to fit within the stator bore with an interference fit, i.e., there is a compressive fit between the rotor and stator. This compressive fit results in seal lines where the rotor and stator contact. These seal lines define or seal off definite cavities bounded by the rotor and stator surfaces. As the rotor turns within the stator, the cavities defined by the seal lines progress from the suction end of the pump to the discharge end of the pump.

Typical progressing cavity pumps can be used to pump a wide range of fluids including fluids with solids in suspension, high viscosity fluids, and shear sensitive fluids; and since pumps of this type are positive displacement pumps, they can pump fluids with entrained gases without vapor locking.

A disadvantage with typical progressing cavity pumps is that it is often-times difficult to introduce certain materials (i.e., fluids with entrained solids or highly viscous fluids) into the individual cavities during the pumping operation. For example, a common phrase heard in the industry is, "if only we can get that product into the pump elements, it would pump."

One known method for transporting the materials to the pump elements is with the use of augers to convey a product horizontally towards the pump elements. However, such means are only marginally effective, and further, it does not significantly improve upon the introduction of heavily viscous fluids into the pump elements. Various mechanical devices have been used in an attempt improve the feeding of viscous fluids into progressing cavity pumps. Devices such as bridge breakers or paddle pushers have been installed directly in the suction housings. Other devices, such as AugMentor or twin screw feeders have been added to the suction housings, but these devices often only marginally improve the feeding of material to the rotor and stator.

Accordingly, a need exists for a progressing cavity pump system having an improved solids handling capability and improved capability of handling viscous materials. Additionally, there is a need for a progressing cavity pump system with an improved means for introducing the materials being pumped into the cavities formed by the pump elements.

SUMMARY

The present invention provides a progressing cavity pump in which the stator has been modified to increase the size of the opening into the cavities formed by the pump elements; and in particular, a progressing cavity pump in which portions of the stator have been removed or cut away so as to provide a degree of radial access to the cavities formed by the pump elements within the progressing cavity pump suction chamber.

One embodiment of such a modified stator includes a removed portion which results from a planar cut that starts from the suction end of the stator, approximate the central axis of the internal stator bore, is angled towards the discharge end of the stator and outwardly away from the central axis, and intersects an internal helical groove of the stator that defines a first cavity. Preferably, this planar cut substantially intersects the major cross-sectional diameter of the helical groove defining the first cavity and also intersects the minor cross-sectional diameter of the internal helical groove, closest to the suction end of the stator, which defines the first cavity. As there are at least two helical grooves defining the internal stator bore for any progressing cavity pump stator, there is preferably as many of such planar cuts as there are helical grooves, each cut intersecting a corresponding one of the helical grooves as described above.

When such a modified stator is extended into a suction chamber of the progressing cavity pump system, the material being pumped will surround the stator and the expanded radial openings to the internal pump cavities as provided by the planar cuts, and thus will be able to enter the cavities through such radial openings, thereby improving the material handling capabilities of the pump.

It is also an embodiment of the present invention to arrange the rotor and stator elements substantially horizontally, and provide an inlet chamber positioned substantially above one of the removed portions of the stator. Thus, materials may be "dropped" into the cavity formed by the stator and rotor elements, through the removed portion, with the assistance of gravity. In the operation of this embodiment, it is not necessary to provide seals for the joint and the drive mechanisms since the suction pressure created is sufficient to pull the fluid being pumped downstream and away from these components.

In another embodiment of the present invention, the removed portion of the stator is a radial "cut-out" which follows the internal helical groove or major diameter of the stator, and preferably one cut-out is provided for each helical groove defining the internal stator bore. Accordingly, when such a modified stator is extended into an inlet chamber of a progressing cavity pump system, the material being pumped will circumferentially surround the stator and will enter into the cavities formed by the stator and pump elements through the side of the stator where the radial cut-outs exist. Furthermore, such side access provided by these cut-outs allows for the possibility of using one progressing cavity pump to meter several different types of materials. In an arrangement such as this, the inlets to the pump would be divided into separate chambers where each chamber would feed a single cut-out. The different materials would not commingle because each material would be transported within a distinct cavity formed by the rotor and stator elements.

Accordingly, it is an object of the present invention to provide a modified stator which provides a larger opening through which materials and fluids can enter into the cavities formed by the rotor and stator elements of a progressing cavity pump; it is a further object of the present invention to provide a stator modification which facilitates the handling of larger solids within a progressing cavity pump; and it is an object of the present invention to provide a modification to the stator which improves suction conditions and reduces cavitation within progressing cavity pumps.

It is also an object of the present invention to provide a progressing cavity pump which comprises an inlet chamber; a progressing cavity rotor including at least one external helical lobe, having a suction end segment and a discharge end segment; and a progressing cavity stator having an internal stator bore extending axially therethrough, the stator bore including one more internal helical groove than the number of external helical lobes of the rotor; where the rotor is rotationally disposed in the internal bore of the stator so that the external helical lobe of the rotor and the internal helical grooves of the stator define a plurality of cavities there between; where the suction end segments of the rotor and stator extend into the inlet chamber; and where a first potion of the suction end segment of the stator extending into the inlet chamber is removed so as to provide a radial opening to a first cavity formed within the inlet chamber.

It is also an object of the present invention to provide a stator for a progressing cavity pump which comprises a longitudinal member having a suction end segment, a discharge end segment and an internal bore extending axially therethrough, where the internal bore is defined by at least two internal helical grooves; and where a first portion of the suction end segment of the stator is removed so as to provide a radial opening to the internal bore, and where the first removed portion includes a substantial portion of one of the internal helical grooves. For the purposes of this disclosure a "substantial portion" of an internal helical groove refers primarily to the axial portion of the groove and is at least 40% of the axial portion of the groove.

These and other objects and advantages of the present invention will be apparent from the following description, the accompanying drawings and the appended claims.

BRIEF DESCRIPTION OF THE DRAWINGS

FIG. 1 is a cross-sectional, elevational view of a prior-art progressing cavity pump system;

FIGS. 2A–2C are prior-art, elevational, end views of rotor and stator elements in a progressing cavity pump system;

For the purposes of this disclosure, similar or identical elements will be identified by the same numeral or numerals for clarity; and although some numerals appearing in prior-art FIGS. 1–2C are also used in FIGS. 3–12, it is by no means intended as an admission that any element appearing in FIGS. 3–12 is prior art.

DETAILED DESCRIPTION

Figure 3:
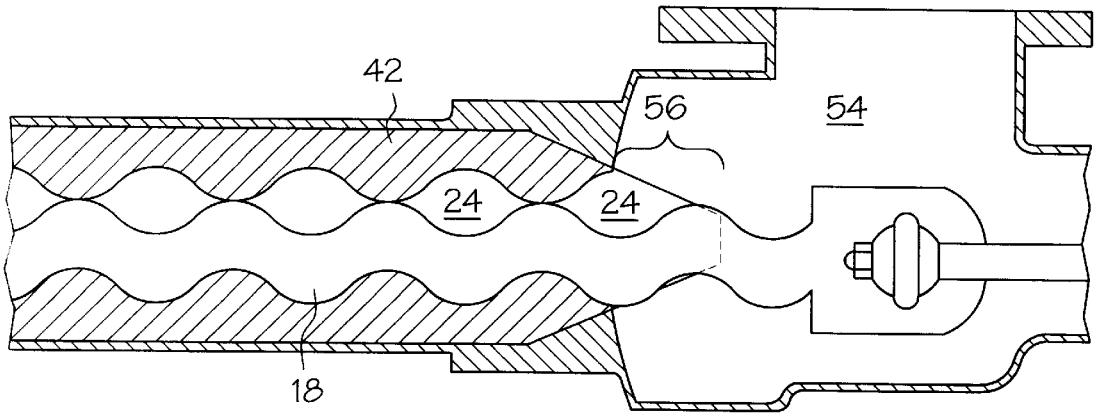
FIG. 3 is a cross-sectional, elevational view of a progressing cavity pump system incorporating an embodiment of the present invention.

As shown in FIG. 1, a conventional progressing cavity pump system 10 includes an inlet chamber, or suction chamber 12, and a discharge port 14. The pump includes a cylindrical stator tube 16, a single lead helical screw or rotor 18, and a double lead helical nut or stator 20, having an internal bore 22 extending longitudinally therethrough. Because the stator is in the form of a double lead helical nut, the stator will include a pair of internal helical grooves 39*a*, 39*b* which define the internal bore. Likewise, the rotor will include one external helical lobe. The rotor is rotationally disposed within the internal bore 22 so that the external helical lobe of the rotor and the internal helical grooves of the stator define a plurality of cavities 24 therebetween. The stator 20 is typically formed from a resilient and flexible elastomeric material, and the rotor 18 is typically manufactured from a metallic material; however, it is within the scope of the invention to form the rotor from a resilient material and to form the stator from rigid metallic material. The rotor 18 is rotatably driven by a drive shaft 26 which is coupled to the rotor by the universal joint 28 as is known to those of ordinary skill in the art. For additional information on the operation and construction of progressing cavity pumps, reference can be made to U.S. Pat. No. 2,512,764 and U.S. Pat. No. 2,612,845.

As the rotor 18 turns within the stator bore 22, the cavities 24 formed between the rotor 18 and the stator 20 progress from the suction end 30 of the rotor and stator elements to the discharge end 32 or the rotor and stator elements. In one revolution of the rotor 18, two separate sets of cavities are formed, one set of cavities opening at exactly the same rate as the second set of cavities is closing. This results in a predictable, pulsationless flow of the fluid. Although the progressing cavity pump 10 shown in FIG. 1 is identified as 1:2 profile elements (which stands for the one helical lobe on the rotor and the two helical grooves on the stator); as is known to those of ordinary skill in the art, other more complex progressing cavity pumps are available such as 9:10 designs where the rotor has 9 lobes and the stator has 10 grooves (actually any combination is possible so long as the stator has one additional lead than the rotor). As will be described in detail below, the present invention is applicable to the 1:2 design as well as any of the other more complex progressing cavity pump designs.

As shown in FIGS. 2A–2C, the transverse cross-sectional outline of the stator's internal bore 22 is defined by a pair of spaced semi-circular concave ends 34 and a pair of tangents 36 joining the semi-circular ends. As shown in FIG. 2C, at any longitudinal point along the stator, the stator bore 22 will have a major diameter $D_m$ between the apexes of the two concave ends 38 and a minor diameter $D_i$ between the two tangents 40. The two concave ends 38 of the internal stator bore 22 respectively define the pair of internal helical grooves 39*a*, 39*b* of the stator bore.

FIG. 2A shows the rotor 18 at the bottom of the stator bore 22 at 0° of rotation, FIG. 2B shows the rotor when it has been rotated 90°, and FIG. 2C shows the rotor after it has been rotated 180°. FIGS. 2B and 2A will be repeated when the rotor has rotated through 270° and 360° respectively. FIGS. 2A–2C also illustrate the axial opening 41 into the cavities 24 (see also FIG. 1) during the respective degrees of rotation as would be seen looking into the cavities from the suction chamber 12. As shown in FIGS. 2A and 2C, when the rotor 18 is at either extreme of the stator cavity, the diameter of the axial opening 41 between the rotor and stator is four times the rotor eccentricity ($4E_R$). Therefore, theoretically, a spherical particle having a diameter slightly less than $4E_R$ would fit through this axial opening. However, in order for the pump to handle this size of particle, the sphere would have to begin entering the cavity as the cavity was opening, pass into the cavity when the axial opening was at its maximum, and continue fully into the cavity as the axial opening was diminishing. Theoretically this is possible but will rarely happen with any regularity due to the exact timing required to pass the large particle into the cavity.

In actuality a pump is generally only able to accept solids which are approximately $2E_R$ in size. This is because as the rotor rotates away from the 0, 180 and 360° positions, the first cavity opening diminishes to a minimum value of approximately equal to $2E_R$, while the second cavity is opening to approximately $2E_R$. For this reason, it is conventional to adopt the $2E_R$ size as the maximum particle size that may be handled by prior-art progressing cavity pumps. Of course, as will be appreciated by those of ordinary skill in the art, when considering the maximum particle size a progressing cavity pump can handle, the fluid velocity also has a considerable impact on the size.

Figure 4A:
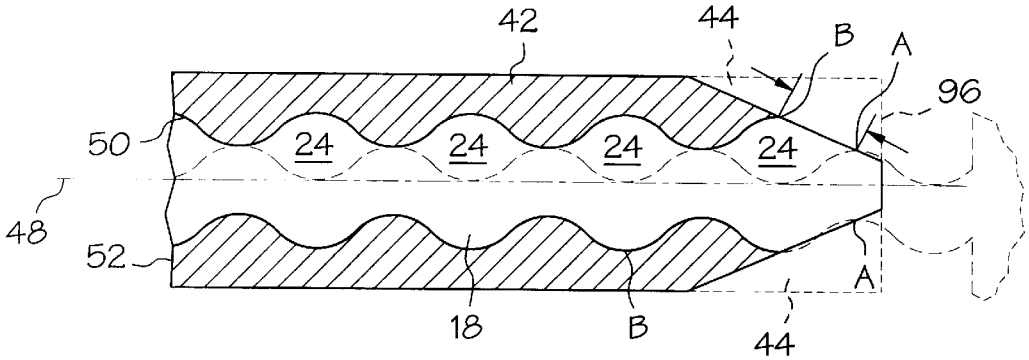
FIG. 4A is a cross-sectional, elevational view of a progressing cavity pump stator of the present invention, and illustrating a progressing cavity rotor and phantom.
Figure 4B:
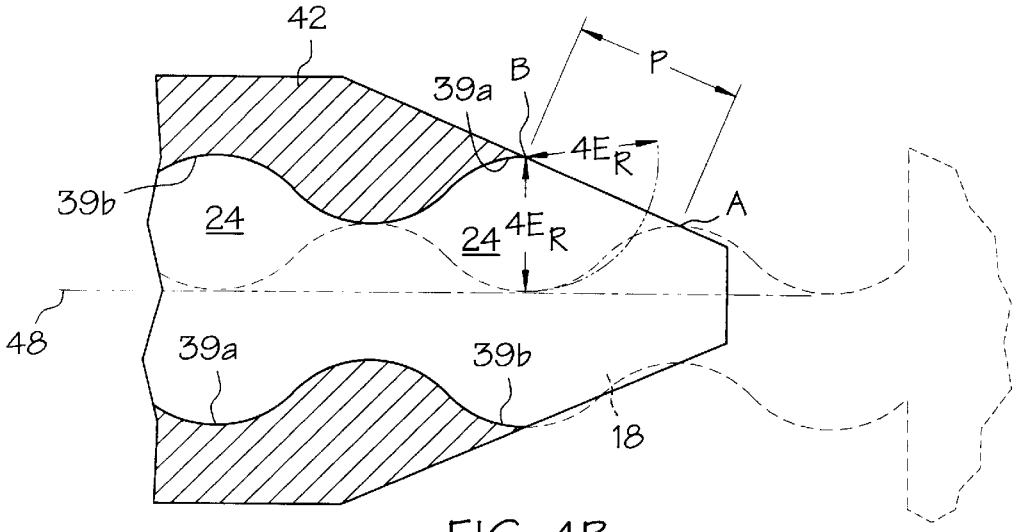
FIG. 4B is a magnified view of the suction end segment of the progressing cavity pump stator of FIG. 4A.
Figure 5:
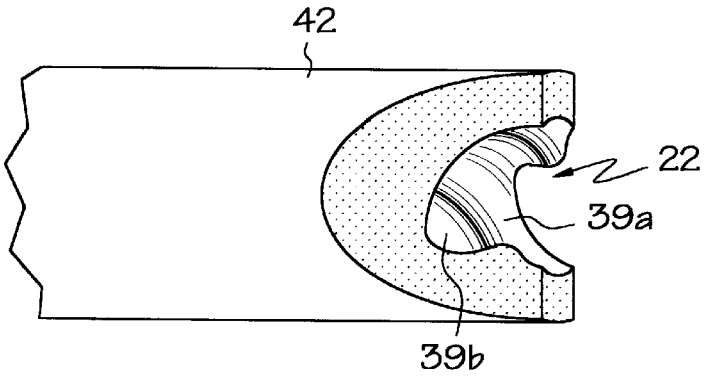
FIG. 5 is a perspective view of a progressing cavity stator according to the present invention.

As shown in FIGS. 3–5, a first embodiment of the present invention includes a progressing cavity stator 42 that has been modified to enhance the ease of entry of fluid and/or solids into the cavities 24 formed between the rotor 18 and stator 42. As shown in FIG. 4*a*, the stator 42 includes two portions 44 removed therefrom, one for each lead or groove of the internal stator bore so as to enhancing access of the cavities 24 formed between the stator 42 and rotor 18. Generally, each removed portion results from a planar cut starting at the suction end 46 of the stator proximal a central axis 48 of the internal stator bore 50, which is angled towards the discharge end 52 and outwardly away from the central axis 48, and which intersects the internal helical groove of the stator defining the first cavity. Preferably, the planar cut substantially intersects the internal helical groove at the major cross-sectional diameter B of the internal helical groove and at the minor diameter A of the internal helical groove, closest the suction end. Such a planar cut exposes approximately 50% of the axial portion of the groove. As shown in FIG. 4*b*, a stator 42 modified in such a way provides a substantially larger opening P into the cavity 24 than the maximum axial opening of $4E_R$ provided by the prior art. This is because the modified stator 42 provides a degree of radial access to the cavity (i.e., accessible from a radial point, and not axial, from the cavity), as opposed to the strictly axial access as provided by the prior art shown in FIGS. 1 and 2A–2C. Accordingly, the opening is no longer strictly an axial opening, but includes direct radial access as well.

As shown in FIG. 3, the suction chamber 54 is also modified such that the rotor 18 and stator 42 have suction end segments 56 which extend into the suction chamber 54. Accordingly, the material in the suction chamber is permitted to circumferentially surround the stator 42, facilitating the radial access to the cavities 24 formed by the pump elements; and thereby improving the suction characteristics of the pump and the ability of the pump to handle larger size solids.

Although shown in FIGS. 3–5 as a 1:2 element pump; it is within the scope of the invention to provide a similar modified stator for more complex element pumps; and preferably, one planar cut will be provided for each helical groove defining the internal stator bore.

Figure 6:
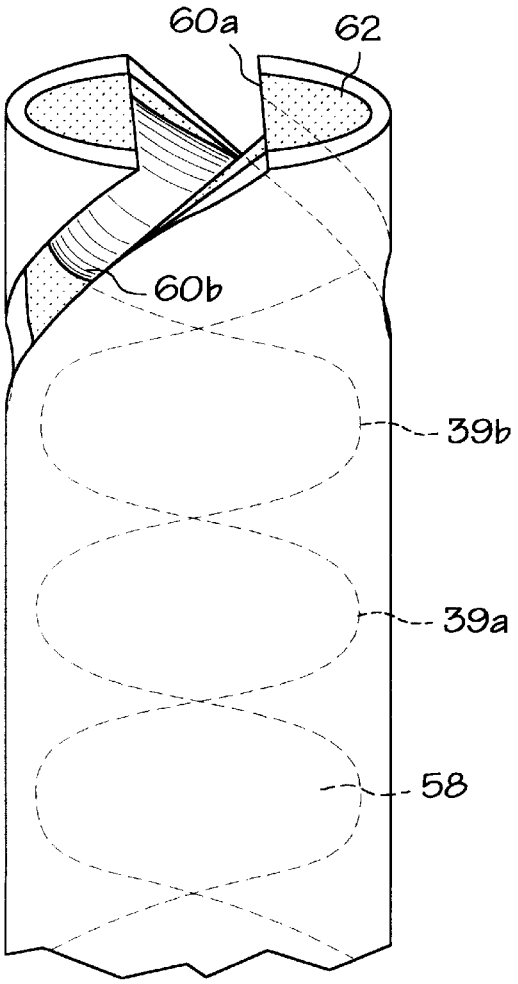
FIG. 6 is a perspective view of a progressing cavity stator according to another embodiment of the present invention.
Figure 8:
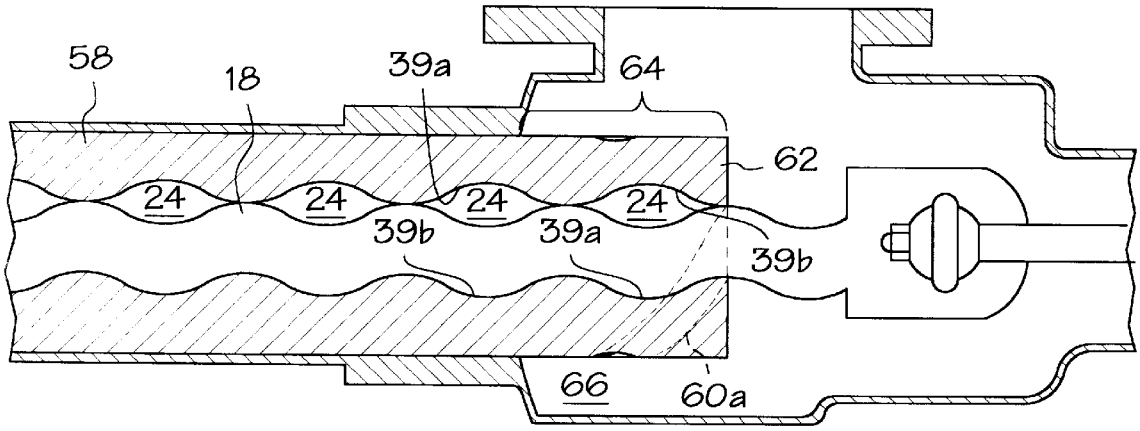
FIG. 8 is a cross-sectional, elevational view of a progressing cavity pump system incorporating the progressing cavity stator of FIG. 6.

As shown in FIGS. 6 and 8, another embodiment of a modified stator of the present invention 58 includes two radial cut-out portions 60*a*, 60*b* which provide direct radial access to the internal helical grooves 39*a*, 39*b* of the stator bore. These cut-out portions 60*a*, 60*b* each follow a respective helical groove 39*a*, 39*b* of the stator bore and open onto the suction end 62 of the stator. Such cut-out portions 60*a*, 60*b* expose approximately 50% of the axial portion of the helical groove. As shown in FIG. 8, the stator 58 and rotor 18 include segments 64 which extend into an inlet chamber 66 of a progressing cavity pump. Accordingly, the material in the suction chamber is permitted to circumferentially surround the stator 58, facilitating the radial entry into the cut-out portions 60*a*, 60*b*, and in turn, into the cavities 24 formed by the pump elements; thereby improving the suction characteristics of the pump and the ability of the pump to handle larger size solids. This embodiment 58 is also especially designed for allowing thick crude oil to flow into the cavities from 360° around the stator, and will thus improve suction conditions and a reduce cavitation.

Although shown in FIGS. 6 and 8 as a 1:2 element pump; it is within the scope of the invention to provide a similar modified stator for more complex element pumps; and preferably, one radial cut-out will be provided for each helical groove defining the internal stator bore.

Figure 7:
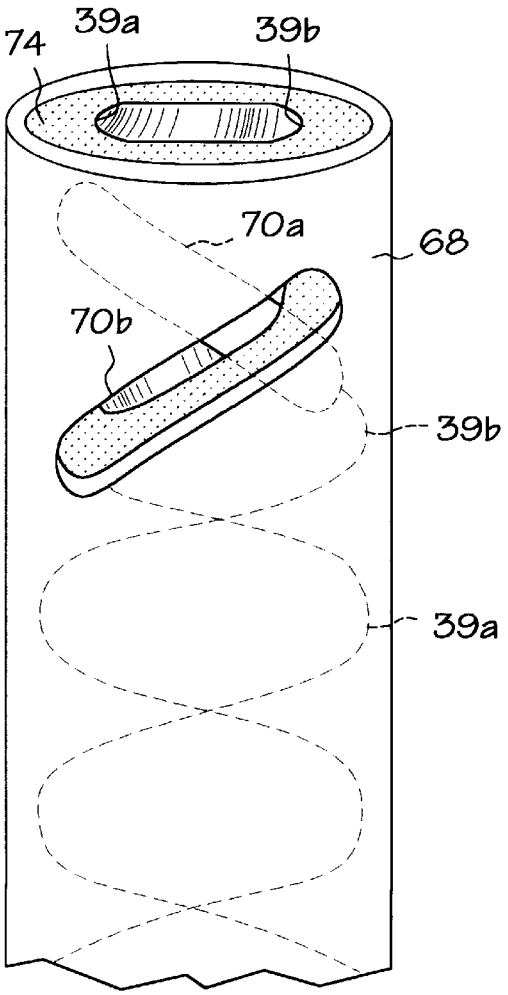
FIG. 7 is a perspective view of a progressing cavity stator according to yet another embodiment of the present invention.
Figure 9:
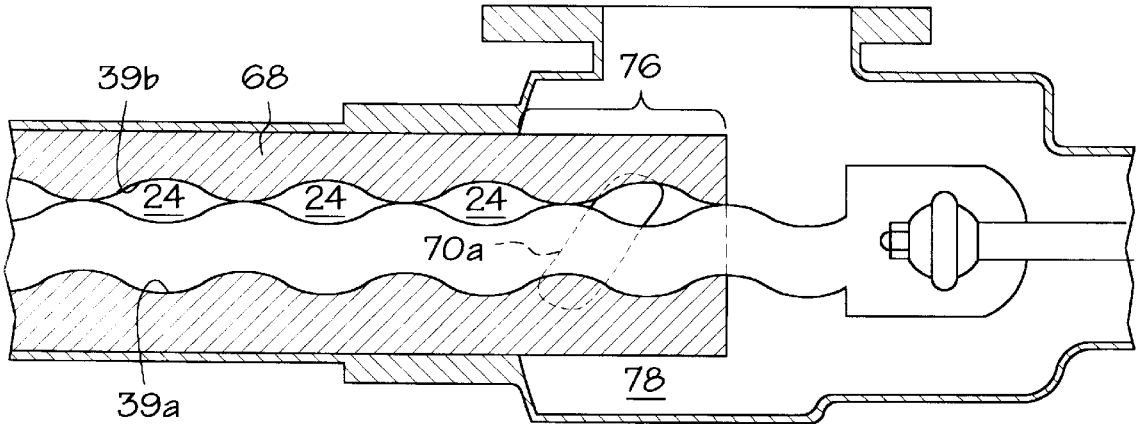
FIG. 9 is a cross-sectional, elevational view of a progressing cavity pump system incorporating the progressing cavity stator of FIG. 7.

As shown in FIGS. 7 and 9, yet another alternate modified stator 68 of the present invention includes a pair of radial cut-outs 70*a*, 70*b* which follow the internal helical grooves 39*a*, 39*b* of the internal stator bore 72. However, rather than opening onto the distal end 74 of the stator 68 the cut-outs 70*a*, 70*b* are closed off from one another. Such cut-out portions 70*a*, 70*b* expose approximately 50% of the axial portion of the helical groove. As shown in FIG. 9, both the stator 68 and rotor 18 have segments 76 extending into an inlet chamber 78 so as to allow materials to flow into the stator cavities 24 from 360° around the stator 68; thereby improving the suction characteristics of the pump and the ability of the pump to handle larger size solids.

Although shown in FIGS. 7 and 9 as a 1:2 element pump; it is within the scope of the invention to provide a similar modified stator for more complex element pumps; and preferably, one radial cut-out will be provided for each helical groove defining the internal stator bore.

Figure 10:
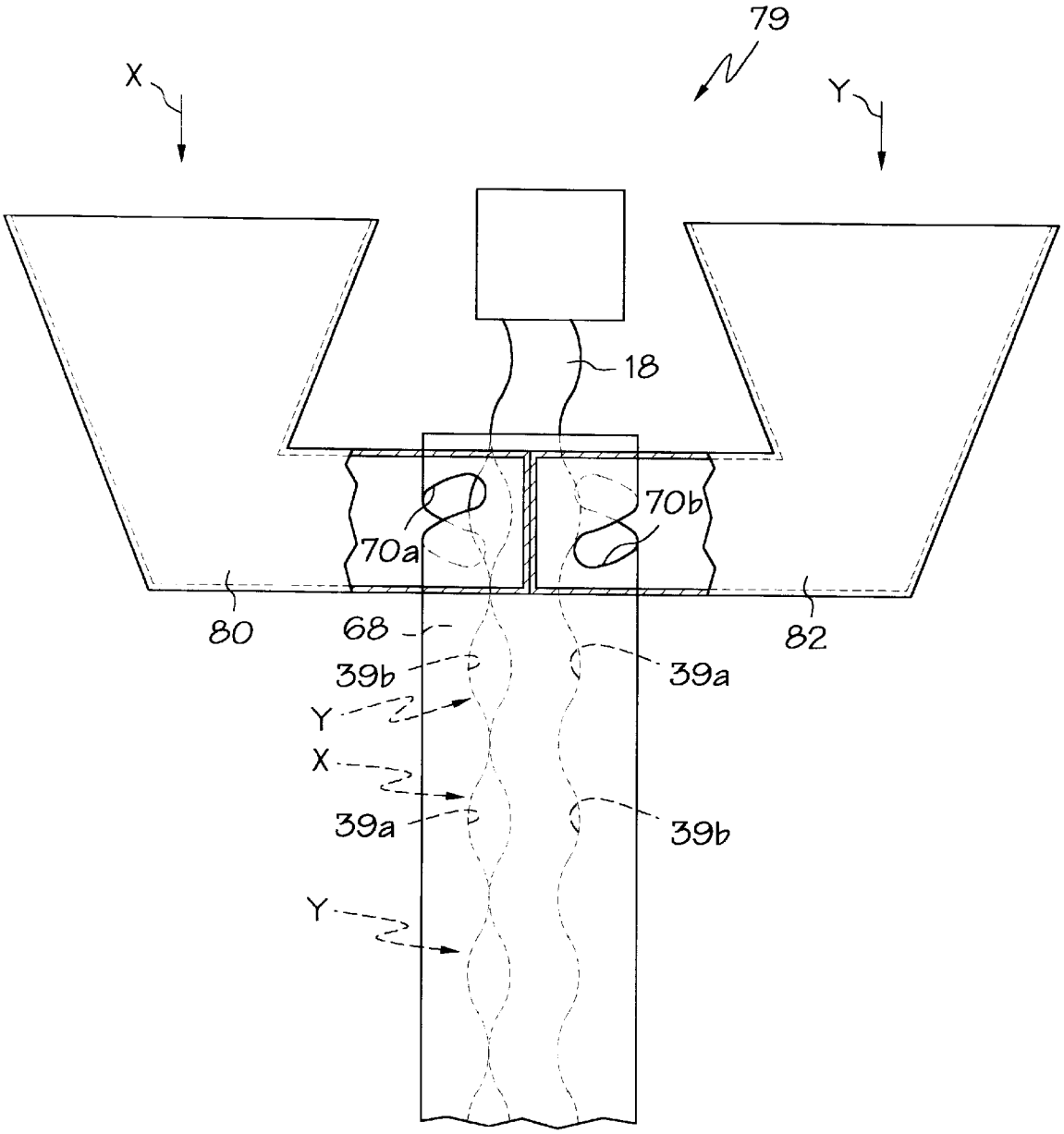
FIG. 10 is an alternate embodiment of a progressing cavity system incorporating the progressing cavity stator of FIG. 7.

As shown in FIG. 10, the improved stator 68 of FIGS. 7 and 9 also facilitate metering of multiple fluids from the same pump. In the embodiment of FIG. 10, the inlet chamber can be broken into two distinct subchambers 80, 82 each being supplied with a distinct material (x, y respectively), where the two subchambers 80, 82 are sealed from one another. Additionally, each subchamber 80, 82 is mounted to a circumferential side of the stator 68 over a corresponding one of the two stator openings 70*a*, 70*b*. Accordingly, by this arrangement, each material will be deposited into separate, alternating cavities and will thus be pumped simultaneously by the single pump 79. Accordingly, the pump 79 of FIG. 10 could be used to meter two distinct fluids using the same pump, such as part-a epoxy and part-b epoxy.

Figure 11:
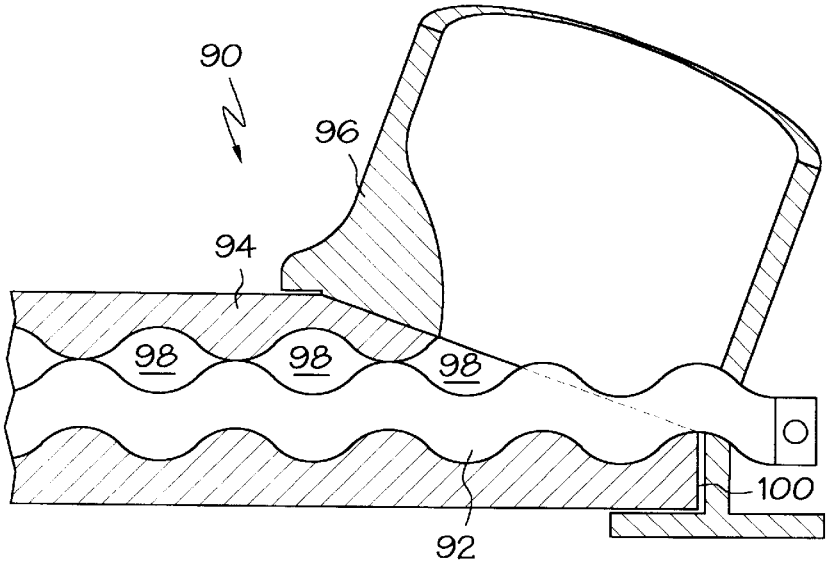
FIG. 11 is a cross-sectional, elevational view of a progressing cavity pump system incorporating yet another embodiment of the present invention.

As shown in FIG. 11, yet another embodiment of the present invention 90, the rotor and stator pump elements 92, 94 are oriented substantially horizontally, and a portion of the upward facing radial side of the stator is cut away to provide access to the rotor 92 from a suction chamber 96 mounted to the upward facing radial side of the stator. In this embodiment, the material to be pumped is "dropped" right onto the rotor 92 and essentially right into the cavities 98 formed between the rotor and stator pump elements. The removed portion of the stator in this embodiment results from a planar cut which intersects the suction end 100 of the stator proximal a central axis of the internal bore. The cut is angled towards the discharge end, crossing the central axis, and intersects the internal helical groove of the stator defining a cavity distal from the suction end 100 of the stator so as to completely remove the axial portions of several grooves. The suction chamber 96 is tilted to match the angle of the cut.

Figure 12:
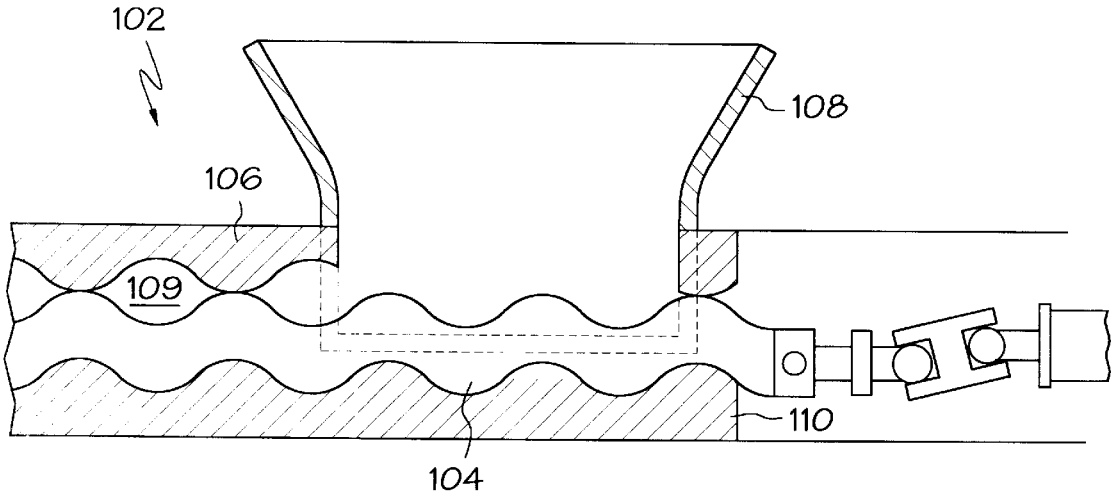
FIG. 12 is a cross-sectional, elevational view of a progressing cavity pump system incorporating yet another embodiment of the present invention.

As shown in FIG. 12, yet another embodiment of the present invention 102, the rotor and stator pump elements 104, 106 are oriented substantially horizontally, and a portion of the upward facing radial side of the stator is cut-out to provide access to the rotor 104 from a suction chamber 108 mounted to the upward facing radial side of the stator. In this embodiment, the material to be pumped is "dropped" right onto the rotor 104 essentially right into the cavities 109 formed between the rotor and stator pump elements. The openings in the stator in this embodiment are created by removing a radial cut-out from the axial portions of several grooves near the suction end 110 of the stator.

Following from the above description, it should be apparent to those of ordinary skill in the art that, while the designs and operations herein described constitute several embodiments of the present invention, it is to be understood that the invention is not limited to these precise designs and operations, and that changes may be made therein without departing from the scope of the invention as recited in the following claims.

What is claimed is:

1. A stator for a progressing cavity pump comprising:

a longitudinal member having a suction end segment, a discharge end segment and an internal bore extending axially therethrough, the internal bore being defined by at least two internal helical grooves;

wherein a first portion of the suction end segment of the stator is removed so as to provide a radial opening to the internal bore, the first removed portion including a substantial axial portion of an internal helical groove;

wherein the stator has a suction end and a discharge end; and wherein the first removed portion of the stator results from a planar cut intersecting the suction end of the stator proximal a central axis of the internal bore, angled towards the discharge end and outwardly away from the central axis, and intersecting the internal helical groove.

2. The stator of claim 1, wherein:

a second portion of the suction end segment of the stator, diametrically opposing the first removed portion of the stator, is removed from a planar cut intersecting the suction end of the stator proximal the central axis of the internal bore, angled towards the discharge end and outwardly away from the central axis, and intersecting another helical groove.

3. A stator for a progressing cavity pump comprising:

a longitudinal member having a suction end segment, a discharge end segment and an internal bore extending axially therethrough, the internal bore being defined by at least two internal helical grooves;

wherein a first portion of the suction end segment of the stator is removed so as to provide a radial opening to the internal bore, the first removed portion including a substantial axial portion of an internal helical groove;

wherein each internal helical groove defines a cross-sectional major diameter of the internal bore; and wherein the first removed portion of the stator results from a planar cut taken at an acute angle with respect to a central axis of the stator bore, intersecting the internal helical groove at its major diameter.

4. A progressing cavity pump comprising:

an inlet chamber;

a progressing cavity rotor including at least one external helical lobe, having a suction end segment and a discharge end segment; and a progressing cavity stator having an internal bore extending axially therethrough, having a suction end segment and a discharge end segment, the stator including one more internal helical groove than the number of external helical lobes of the rotor, the internal helical grooves defining the internal bore;

the rotor being rotationally disposed in the internal bore of the stator so that the external helical lobe of the rotor and the internal helical grooves of the stator define a plurality of cavities therebetween;

the suction end segments of the rotor and stator extending into the inlet chamber;

a first portion of the suction end segment of the stator extending into the inlet chamber being removed so as to provide at least a radial opening to a first cavity within the inlet chamber;

the stator having a suction end and a discharge end; and the first removed portion of the stator resulting from a planar cut which intersects the suction end of the stator proximal a central axis of the internal bore, which is angled towards the discharge end and outwardly away from the central axis, and which intersects the internal helical groove of the stator defining the first cavity.

5. The progressing cavity pump of claim 4, wherein:

a second portion of the stator is removed on an opposite radial side of the stator so as to provide a radial opening to a second cavity within the inlet chamber.

6. The progressing cavity pump of claim 4, wherein:

the internal helical groove of the stator defines a major cross-sectional diameter of the internal bore and a minor cross-sectional diameter of the internal bore;

the planar cut substantially intersects the major cross-sectional diameter of the internal helical groove defining the first cavity and intersects the minor cross-sectional diameter of the internal helical lobe, closest to the suction end, which defines the first cavity.

7. The progressing cavity pump of claim 4, wherein:

the rotor and stator are arranged substantially horizontally; and the inlet chamber is positioned substantially above the first removed portion of the stator;

whereby materials may be dropped into the first cavity, through the first removed portion, with the assistance of gravity.

* * * * *